United States Patent [19]

Gunton

[11] Patent Number: 4,809,008

[45] Date of Patent: Feb. 28, 1989

[54] BROADBAND MICROSTRIP ANTENNA

[75] Inventor: David J. Gunton, Stakeford, England

[73] Assignee: British Gas plc, London, England

[21] Appl. No.: 947,898

[22] Filed: Dec. 30, 1986

[30] Foreign Application Priority Data

Dec. 30, 1985 [GB] United Kingdom ..... 8531859

[51] Int. Cl.[4] ..... H01Q 1/38

[52] U.S. Cl. ..... 343/700 MS

[58] Field of Search ..... 343/700 MS

[56] References Cited

U.S. PATENT DOCUMENTS

| | | | |
|---|---|---|---|
| 4,138,684 | 2/1979 | Kerr | 343/700 MS |
| 4,218,682 | 8/1980 | Yu | 343/700 MS |
| 4,320,402 | 3/1982 | Bowen | 343/700 MS |
| 4,605,932 | 8/1986 | Butscher et al. | 343/700 MS |

FOREIGN PATENT DOCUMENTS

| | | | |
|---|---|---|---|
| 0217703 | 10/1985 | Japan | 343/700 MS |
| 2064877 | 6/1981 | United Kingdom | 343/700 MS |

OTHER PUBLICATIONS

Microstrip Antenna Array for 12 GHz TV, Collier, M., Microwave Journal, vol. 20, No. 9, pp. 67–73.

*Primary Examiner*—William L. Sikes
*Assistant Examiner*—Doris J. Johnson
*Attorney, Agent, or Firm*—Oblon, Fisher, Spivak, McClelland & Maier

[57] ABSTRACT

An antenna assembly which comprises a first laminar structure which includes a sheet of dielectric material having on one side a contiguous metal sheet and on the other side a strip transmission line adapted to be coupled with signal feeding means, and a second laminar structure, one side of which is in contact with the transmission line, and having on the other side, at least one region but preferable at least two concentrically arranged regions of a coated or cladded metal which serves as a radiator, characterized in that the transmission line is non-symetrically disposed with respect to the radiator.

3 Claims, 2 Drawing Sheets

FIG. 1.
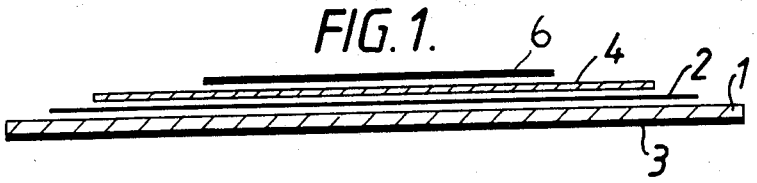
FIG. 2.
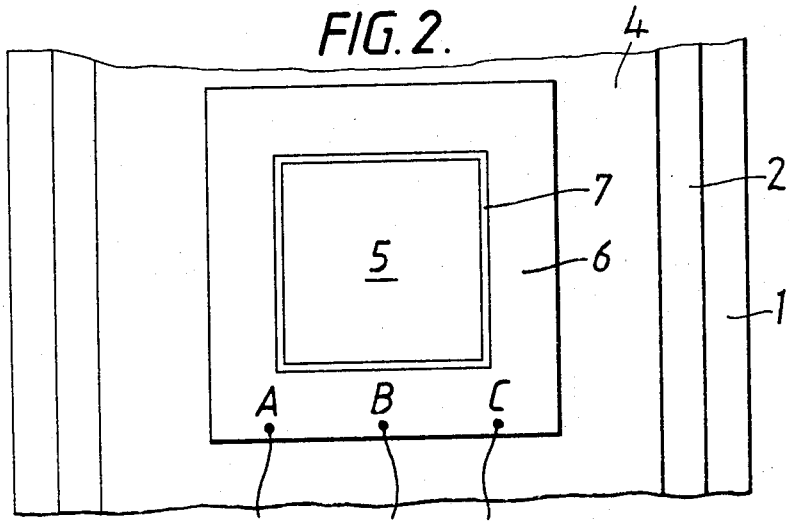
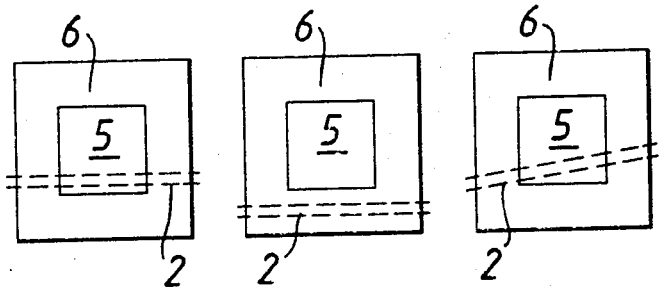
FIG. 3a. FIG. 3b. FIG. 3c.

FIG. 4a.
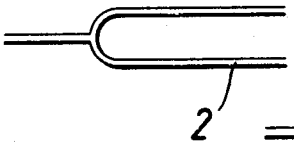
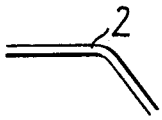
FIG. 4b.
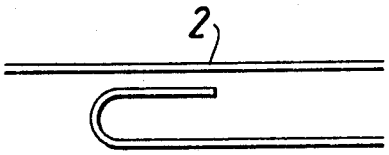
FIG. 4c
FIG. 5.
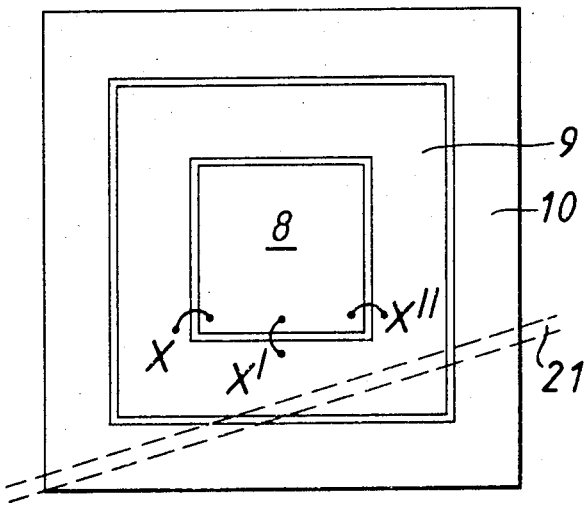
FIG. 6.
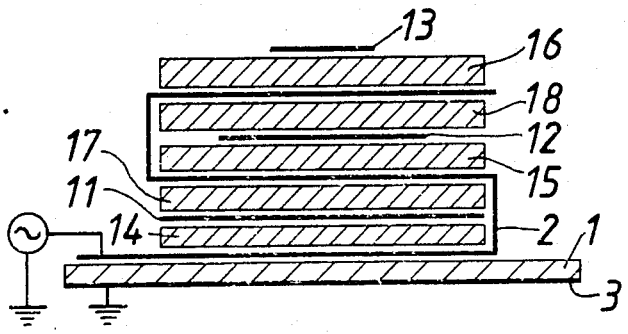

BROADBAND MICROSTRIP ANTENNA

BACKGROUND OF THE INVENTION

1. Field of the Invention:

This invention relates to radar antennas and, more particularly, to microstrip antennas for broadband transmission.

2. Discussion of Background:

Log periodic microstrip antennas are know which consist of a set or series of isolated metal patches on the surface of a thin dielectric sheet. The area of each of the patches varies with its neighbours by some log periodic progression. The thin dielectric sheet is placed above a second sheet, on the lower surface of which is an earth plane and on the upper surface is provided a straight transmission line. A signal is applied to the transmission line and energy is coupled by E & H fields to the metal patches which resonate and radiate.

Such known antennas suffer from the disadvantage that they are large and are not readily amenable for use in portable applications such as ground probing radar for locating buried objects such as non metallic pipework.

SUMMARY OF THE INVENTION

We have found that more compact structures can be produced which take the advantages of microstrip antennas i.e. the inherent shielding from transmission or reception in the backward direction and yet are portable.

According to the present invention there is provided a broadband antenna assembly comprising a first laminar structure which includes a sheet of a dielectric material, on one side of which is mounted a contiguous metal sheet and on the opposing side is mounted a strip transmission line adapted to be coupled with signal feeding means, and a second laminar structure comprising a laminar dielectric sheet, one side of which is in contact with the strip transmission line and on the other side, in at least the peripheral regions, is a coating or clading of a metal which serves as the radiator, characterised in that the transmission line is non-symetrically disposed with respect to the radiator.

The upper surface of the second laminar structure may be clad or coated with a single sheet of metallic radiator or the radiators may be in the form of a series of concentrically formed regions.

Alternatively the second laminar structure may be a multi-laminate structure comprising layers of dielectric sheets, the lower surfaces of which contact the strip transmission line and the upper surfaces of which bear metallic sheets of radiator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a schematic side view of a first embodiment of an antenna assembly according to the invention;

FIG. 2 is a plan view of a portion of the antenna assembly according to the invention shown in FIG. 1;

FIGS. 3(*a*), 3(*b*) and 3(*c*) are plan views of other embodiments of a component board of the antenna assembly of the invention;

FIGS. 4(*a*), 4(*b*) and 4(*c*) are side views illustrating different embodiments of the feeding transmission line for the antenna assembly of the invention;

FIG. 5 is a plan view illustrating another embodiment of a component board of the antenna assembly of the invention, and FIG. 6 is a side view, partly in cross-section, of a further embodiment of a antenna assembly according to the invention.

DESCRIPTION OF THE PREFERRED EMBODIMENTS

Referring to the drawings, a typical antenna assembly was constructed as follows:

All circuits are made in etched copper film mounted on 1.6 mm GRP boards, whose relative permitivity is 4.7.

The feed line 2 was of width 2.5 mm, was mounted in or on a GPR board 1, (FIG. 1) approximately 30×30 Ocm. A continuous metal film 3 was present on the back of the board. On the top of the board 1 is found a conventional microstrip transmission line 2. Its impedance was measured as approximately 75 ohm and the velocity of propagation along it measured as 0.55C, where C is the velocity of light ($3\times10^8$ $ms^{-1}$). The signal was introduced to the line through a SMA-style microstrip connector (not shown) mounted with its axis perpendicular to the plane of the board. A like connector at the other end of the stripline carried a 50 ohm load.

On a metal coated GPR board 4 of dimensions 21 cm×21 cm a gap 7 of 1.0 mm was etched to define two regions (FIG. 2). The inner region 5 was a 10×10 cm square and was surrounded by a concentric region 6 whose outer edges were 14.5 cm. There was no metal backing to the board 4.

The two boards 1 and 4 were clamped together with a film of petroleum jelly between them to aid dielectric continuity. Short wires were soldered at A, B and C so as to give electrical continuity. The performance of the antenna varied depending on the positioning of the pattern relative to the stripline below it. Useful configurations are shown in FIGS. 3(*a*), (*b*) (*c*).

Two identical antennas were produced, one used as transmitter and one as receiver. Transmission was observed to occur at 550 MHz and 760 MHz. These frequencies corresponded to those at which the overall length (14.7 cm) and the length of the inner rectangle (10 cm) corresponded to a half-wavelength, taking account of the dielectric slowing properties of the substrate.

The structure of FIG. 3(*b*) had a response at 760 MHz no appreciable transmission at 550 MHz. The structure of FIG. 3(c) had a frequency response at 550 MHz and 760 MHz.

In addition to all the results described above there were the harmonics (multiples) at higher frequencies.

The power of the method of coupling of the input signal by fields rather than by direct connection, as in conventional microstrip 'patch' antennas, is that the feeding transmission line can itself be adjusted in its properties. For example, it need not be straight, it could divide so as to feed several parts of the radiator at once, it could include frequency sensitive components such as filters or directional couplers. Examples are illustrated in FIGS. 4(*a*), (*b*) (*c*).

For an extended passband the sections into which the antenna is divided are suitably formed. For example, the width of the transmission peaks observed experimentally was approximately 10% of the centre frequency. Thus, if the ratio of successive sections is approximately 5% the passbands will merge, and the total number of sections will determine the overall bandwidth.

In a further example (FIG. 5), the upper GPR board was configurated to provide three regions 8,9,10.

Metallic links were soldered at X,X',X'', and the position of the feeding transmission line is shown at 21.

The antenna was observed to transmit in frequency bands (of width between 50 and 100 MHz) centered on 550 MHz, 700 MHz and 950 MHz, which approximately correspond to the frequencies at which the length of each rectangle is a half-wavelength.

FIG. 6 illustrates the multilaminate structure arrangement. In this embodiment, the upper GRP board is provided as a stacked layer of boards 14,15,16,17. In alternate interlayers are a plurality of radiators 11,12,13 whose sizes conform to a log periodic progression, and the transmission strip 2.

What is claimed as new and desired to be secured by Letters Patent of the United States is:

1. A broadband antenna assembly comprising:

a ground plane;

plural dielectric layers including a first dielectric layer disposed on one side of said ground plane;

a feed line disposed adjacent said first dielectric layer and separated from said ground plane by said first dielectric layer;

said plural dielectric layers including a second dielectric layer disposed adjacent said feed line and sandwiching said feed line between said first and second dielectric layers;

a plurality of radiators disposed adjacent a side of said second dielectric layer opposite said feed line and separated from said feed line by said second dielectric layer;

said feed line defining an orthogonal projection which crosses at least one of said radiators assymmetrically so as apparently to divide said at least one radiator assymmetrically, wherein any radiator which is not crossed by the orthogonal projection of said feed line is connected to a radiator that is crossed by the orthogonal projection of said feed line;

said radiators having respective sizes selected such that said radiators have respective frequency response bands, which bands merge to produce an overall bandwidth dependent on the total number of radiators;

each radiator having an outer boundary defining an orthogonal projection, wherein the radiator having an outer boundary circumscribing the largest area is disposed adjacent the ground plane and separated therefrom by said first dielectric layer, said feed line and said second dielectric layer; and the orthogonal projection of the outer boundary of each radiator circumscribing the orthogonal projections of the outer boundaries of all those radiators having outer boundaries circumscribing smaller areas.

2. The antenna assembly according to claim 1, wherein plural of said radiators are disposed laterally adjacent on the same dielectric layer, each pair of said laterally adjacent of said plural radiators being separated from each other by a gap which is small in proportion to the area circumscribed by the outer boundary of the smaller of the pair of said laterally adjacent radiators.

3. The antenna assembly according to claim 1, comprising:

plural of said radiators disposed on respective dielectric layers stacked vertically above said ground plane; and said feed line having plural portions interposed between respective of the plural vertically stacked dielectric layers and separated from respective of the vertically stacked radiators by respective of the vertically stacked dielectric layers.

* * * * *